United States Patent [19]

Ehrhardt

[11] 3,968,859

[45] July 13, 1976

[54] MULTIPLE HOSE GUIDE ARRANGEMENT FOR A LIFT TRUCK

[75] Inventor: Benonie C. Ehrhardt, Park Forest, Ill.

[73] Assignee: Allis-Chalmers Corporation, Milwaukee, Wis.

[22] Filed: Dec. 23, 1974

[21] Appl. No.: 536,029

[52] U.S. Cl. ..... 187/9 E; 137/355.17; 214/DIG. 11

[51] Int. Cl.[2] ..... B66B 9/20; B65H 75/34

[58] Field of Search ..... 187/9 E, 9 R; 214/650 R, 650 SG, 651, 652, 653, 654, 655, 660, 670, 671, 672, 673, 674, 730, DIG. 11; 254/190 R; 74/230.01, 203.3, 230.8; 137/355.17, 355.24, 355.25

[56] References Cited

UNITED STATES PATENTS

| | | | |
|---|---|---|---|
| 2,394,458 | 2/1946 | Lull | 187/9 E X |
| 2,582,999 | 1/1952 | Lehmann | 187/9 E |
| 2,611,497 | 9/1952 | Backofen | 214/654 |
| 2,645,372 | 7/1953 | Broersma | 214/652 |
| 2,791,293 | 5/1957 | Schenkelberger | 214/DIG. 11 |
| 2,800,236 | 7/1957 | Schenkelberger | 214/DIG. 11 |
| 2,807,382 | 9/1957 | Schenkelberger | 214/652 |
| 3,080,943 | 3/1963 | Goodall | 187/9 E |
| 3,111,856 | 11/1963 | Backofen | 74/230.3 |
| 3,235,033 | 2/1966 | Quayle | 187/9 E |
| 3,289,870 | 12/1966 | Quayle | 187/9 E X |
| 3,298,463 | 1/1967 | McIntosh | 187/9 E |
| 3,339,768 | 9/1967 | Dixon | 214/650 R X |
| 3,381,704 | 5/1968 | Richardson | 137/355.17 |
| 3,462,028 | 8/1969 | Pi | 214/95 R |
| 3,489,249 | 1/1970 | Stammen | 187/9 E |
| 3,541,928 | 11/1970 | Conwell | 187/9 E X |
| 3,777,853 | 12/1973 | Miller | 187/9 R |
| 3,786,902 | 1/1974 | Ramsey | 187/9 E |

*Primary Examiner*—John J. Love
*Assistant Examiner*—James L. Rowland
*Attorney, Agent, or Firm*—Charles L. Schwab

[57] ABSTRACT

A triple section mast for a lift truck is disclosed in which a single pulley carries two hydraulic supply hoses in one on top of the other relationship thereby minimizing lateral space occupied by the hoses and maximizing the visibility through the mast. The three-stage mast utilizes one single acting hydraulic lift jack extending between the intermediate and inner mast sections and a pair of short single acting hydraulic jacks mounted on the inner mast section with pistons supporting pulleys about which carriage support chains are trained and connected to the carriage on the inner mast section. A hose pulley is supported on each short jack piston in oblique relation to the chain pulley so that the two hoses trained over each hose pulley pass downwardly to the carriage on the laterally inner sides of the chains and pass downwardly at the rear of the short jacks on the laterally outer sides of the carriage support chains where they are connected to two manifolds mounted on the inner mast section. Two pairs of hoses are connected to the manifolds on the inner mast section and are trained one on top of the other around pulleys on the bottom of the intermediate mast section and thence upwardly to a pair of manifolds near the top of the outer mast section. The hose pulleys at the bottom of the intermediate mast section are mounted on a pair of stub axles which also support a pair of load pulleys carrying chains extending between the inner mast section and the outer mast section.

18 Claims, 8 Drawing Figures

MULTIPLE HOSE GUIDE ARRANGEMENT FOR A LIFT TRUCK

BACKGROUND OF THE INVENTION

Heretofore, others have suggested a pair of laterally spaced pulleys for mounting a pair of hoses extending between the carriage and the main frame of a lift truck. Such hose arrangements are shown in U.S. Pat. Nos. 3,111,856; 3,534,766 and 3,474,985. The side-by-side or laterally spaced hose arrangements shown in U.S. Pat. Nos. 3,111,856 and 3,534,766 take up excessive lateral space in the interior of the mast and tend to unduly restrict visibility through the mast.

BRIEF DESCRIPTION OF THE INVENTION

The present invention relates to an improved mast for a lift truck wherein pairs of hoses are trained one on top of the other over pulleys on pistons of hydraulic jacks and on an intermediate section of the mast. The pulleys are supported on the hydraulic jacks above and obliquely to chain pulleys thereon so that the hoses pass downwardly at lateral sides of the carriage lift chain thereby avoiding interference with the chain and minimizing the fore and aft space requirements for the hoses and carriage lift chains. In the illustrated embodiment of this invention, the pair of jacks whose pistons support lift chain pulleys and dual hose pulleys are disposed at opposite lateral sides of a main lift jack and are offset forwardly thereof. By training a pair of hoses over a single pulley in one over the other relationship, the lateral space requirements are reduced and by mounting the hose pulleys obliquely above the carriage lift chain pulleys the fore and aft space requirements are reduced. A further feature of the invention is that the hose and chain pulleys on the intermediate mast section are mounted on different axes on a pair of stationary axles with the hose pulleys being on the laterally inner side of the chain pulleys.

DETAILED DESCRIPTION OF THE DRAWINGS

Figure 1:
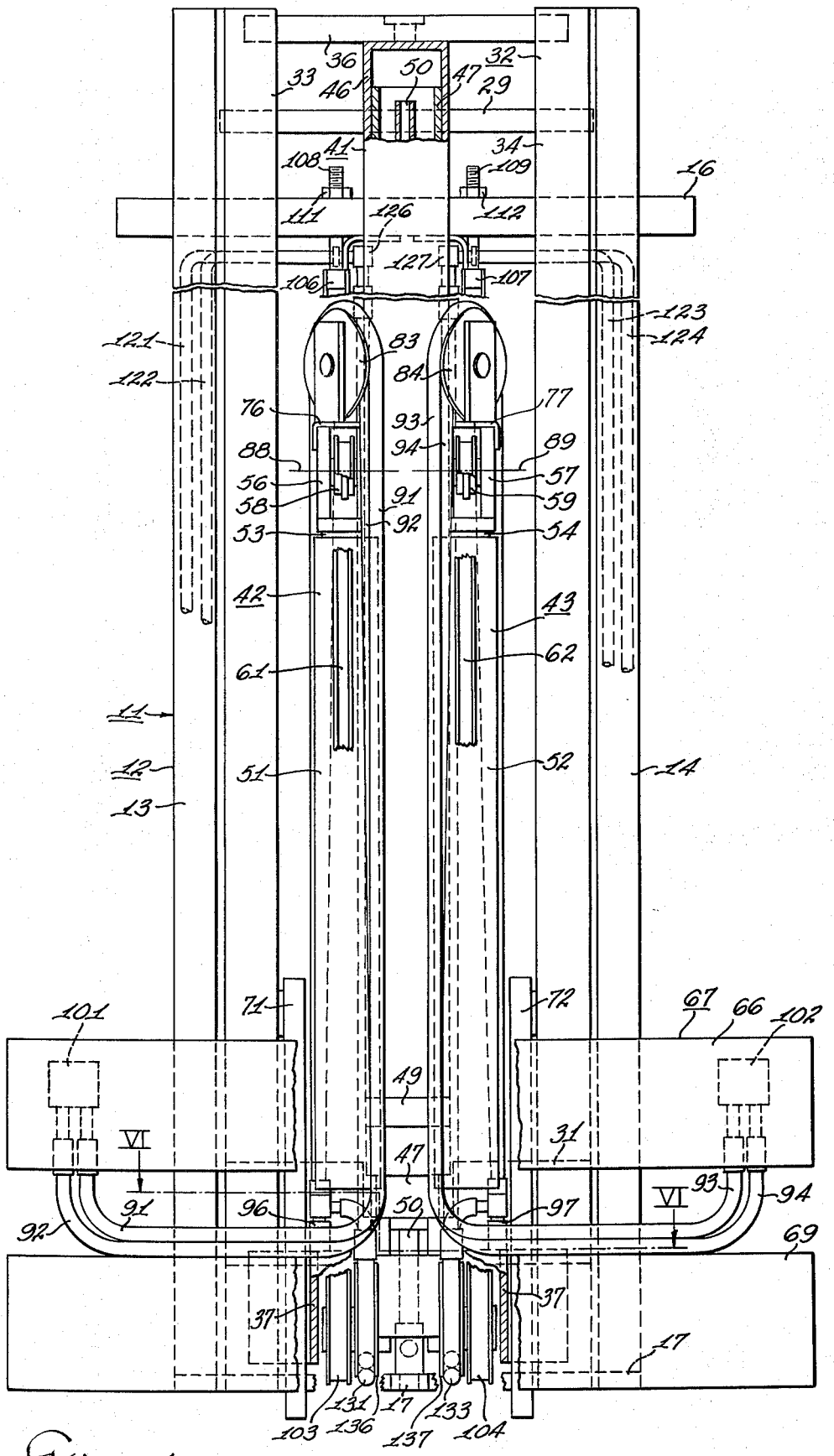
FIG. 1 is a front view of a triple section mast in which the present invention is incorporated with parts broken away for illustration purposes.
Figures 2, 3, 4, 5:
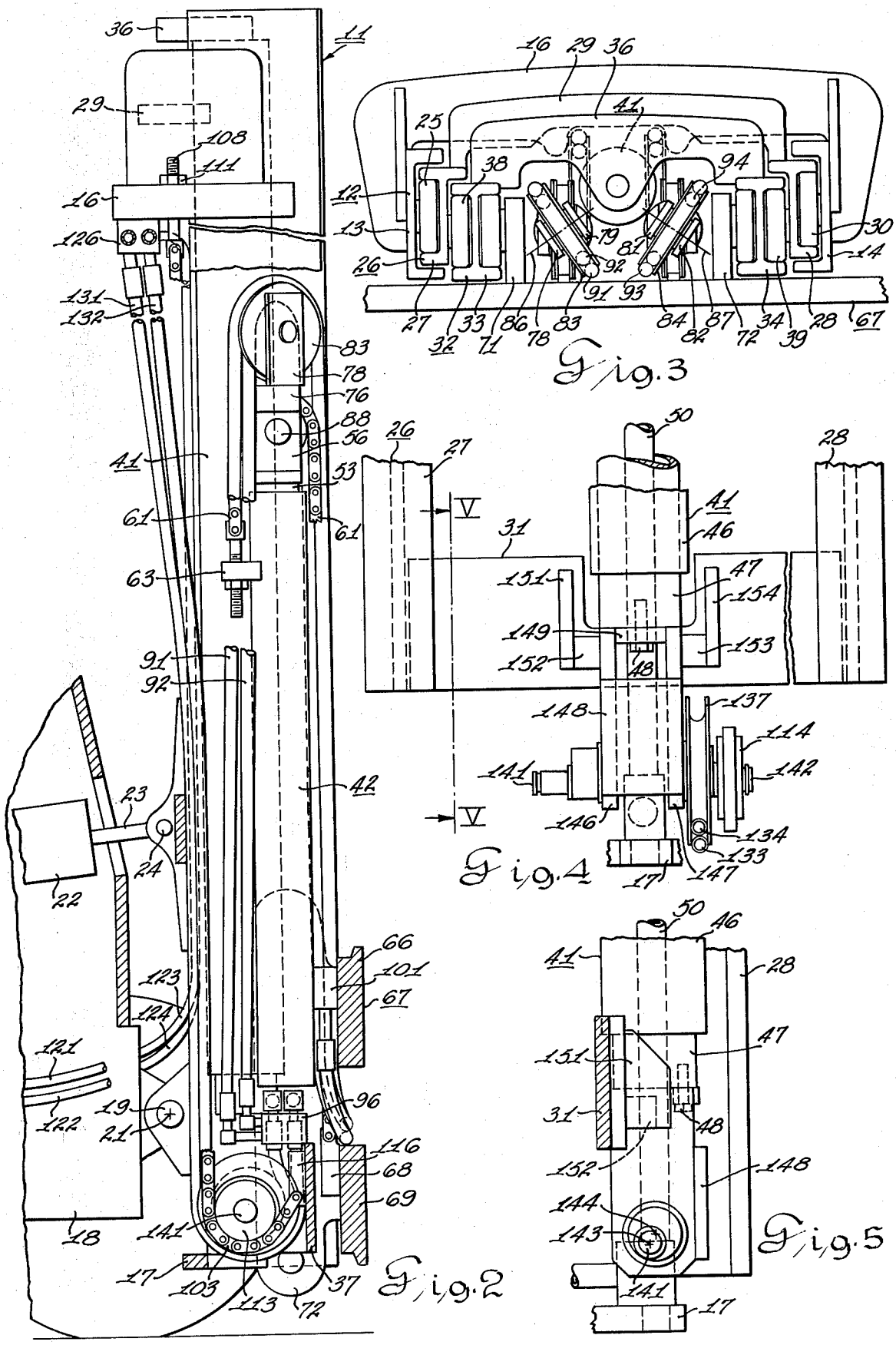
FIG. 2 is a side view of the mast shown in FIG. 1 with pats broken away for illustration purposes.
FIG. 3 is a top view of the mast shown in FIG. 1.
FIG. 4 is a view of the lower end of the intermediate mast section with components removed for illustration purposes.
FIG. 5 is a section view taken along the line V—V in FIG. 4.

Referring to FIGS. 1, 2 and 3, a triple section mast 11 includes an outer mast section 12 having a pair of vertical channel members 13, 14 rigidly interconnected at the upper end thereof by a transverse brace 16 and at the bottom thereof by brace 17. The outer mast section 12 is pivotally connected to the main frame 18 of the lift truck by a pair of pins 19, only one of which is shown, for tilting about a transverse axis 21 by a pair of tilt jacks 22, only one of which is shown. The rod 23 of the tilt jack 22 is pivotally connected to the outer mast section 12 by a pivot pin 24. The mast 11 also includes an intermediate mast section 26 having a pair of upright I-beams 27, 28 rigidly connected at their upper ends by a transverse brace 29 and at their lower ends by a transverse brace 31. The outer mast section 12 rotatably mounts rollers 25, 30 guidingly engaging the intermediate mast section 26.

The mast 11 further includes an inner mast section 32 having a pair of I-beam uprights 33, 34 which are rigidly interconnected at their upper ends by a cross brace 36 and at their lower ends by a curved brace 37. Rollers 38, 39 on the intermediate mast section 26 guidingly engage the inner mast section 32. Hydraulic lift jack means are provided for selectively extending and contracting the telescoping mast sections 12, 26, 32, such means taking the form of a lift jack cluster comprising a central vertical jack 41 and a pair of short vertical jacks 42, 43. The jacks 41, 42, 43 are single acting and hydraulically interconnected by suitable means, not shown. The cylinder 46 of central jack 41 is connected to the cross brace 36 of the inner mast section 32 and the piston 47 of central jack 41 is connected to the cross brace 31 of the intermediate section 26 by a capscrew 48 as illustrated in FIG. 4 and FIG. 5. The cylinder 46 of the long centrally located jack 41 is rigidly secured to the cylinders 51, 52 of the short jacks 42, 43 by a transverse block 49 interconnecting the cylinders 46, 51, 52. Pressure fluid is supplied to the central jack 41 by way of a feed tube 50 mounted at its lower end on brace 17.

Figures 6, 7, 8:
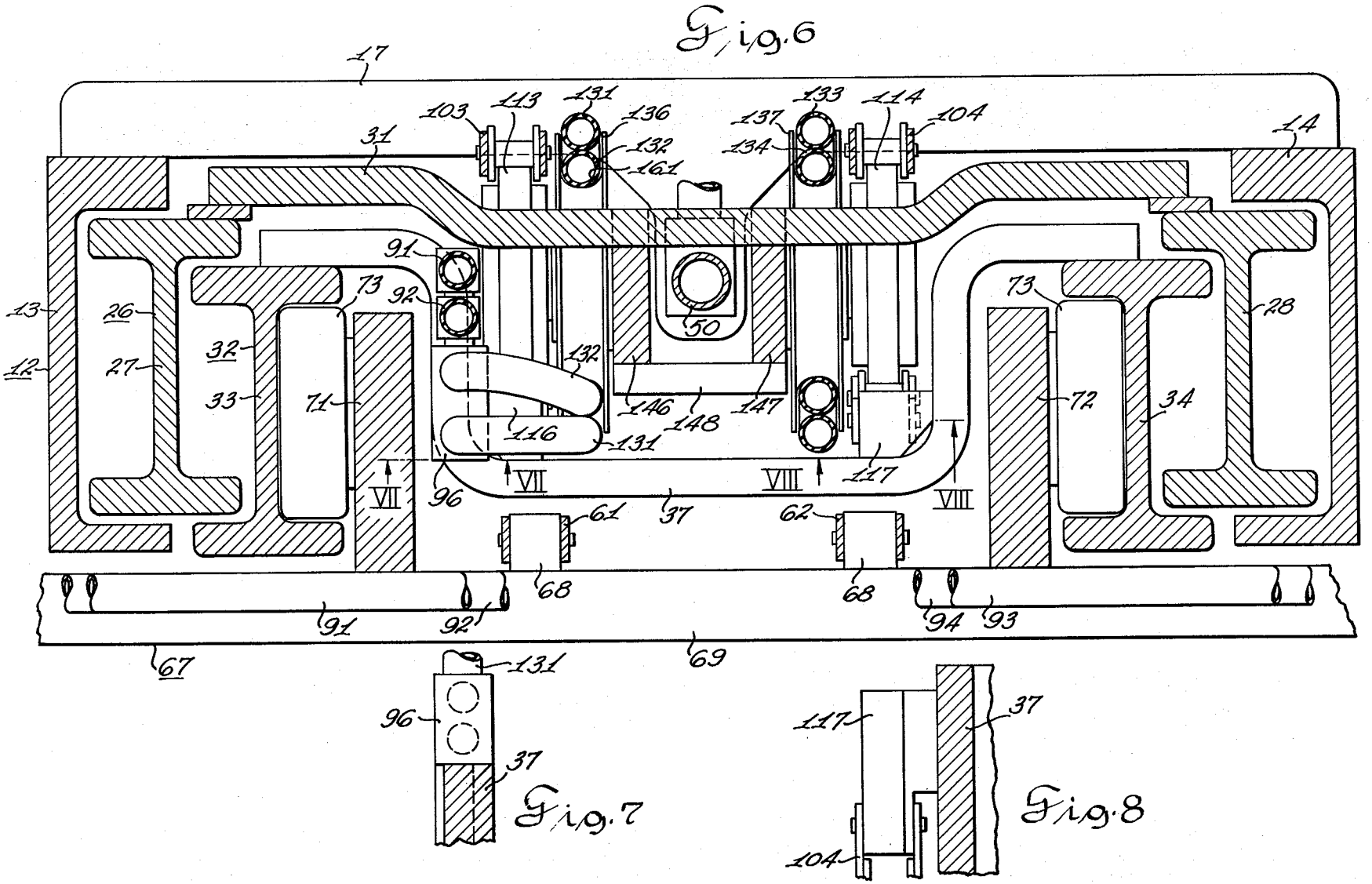
FIG. 6 is an enlarged section view taken along the line VI—VI in FIG. 1.
FIG. 7 is a section view taken along the line VII—VII in FIG. 6.
FIG. 8 is a section view taken along the line VIII—VIII in FIG. 6.

The upper end of the pistons 53, 54 of the short jacks 42, 43 have secured thereto U-shaped brackets 56, 57 to which chain support pulleys 58, 59 are rotatably mounted in alignment with the jacks 42, 43, respectively. Elongated flexible load support members in the form of chains 61, 62 are trained over the support pulleys 58, 59 with their rear ends connected to the backside of the cylinders 42, 43 by brackets 63, only one of which is shown in FIG. 2. Thus since the cylinders 42, 43 are connected to the intermediate mast section 26, the rear ends of chains 61, 62 are also connected to the intermediate mast section. The lower front end of the chains 61, 62 are connected to the backside of the lower transverse plate 69 of a carriage 67 by a pair of brackets 68, as shown in FIG. 6. The carriage 67 also includes an upper transverse plate 66, such plates 66, 69 being rigidly interconnected by a pair of upright brackets 71, 72 welded thereto. The brackets 71, 72 carry rollers 73 engaging the uprights 33, 34 of the inner mast section 32.

Inverted U-shaped members 76, 77 are placed over and secured to the upright legs of U-shaped brackets 56, 57 and serve to support upwardly extending supports 78, 79, 81, 82 welded thereto at their bottoms. The supports 78, 79, 81, 82 rotatably support a pair of hose pulleys 83, 84 on horizontal axes 86, 87 which are at acute angles to vertical planes through the axes 88, 89 of the chain support pulleys 58, 59. In other words, the hose pulleys 83, 84 lie in vertical planes oblique to vertical planes of chain support pulleys 58, 59. The hose pulleys 83, 84 lie in vertical planes converging forwardly whereas the chain support pulleys 58, 59 lie in parallel vertical planes extending fore and aft in relation to the mast 11. The angularly mounted hose pulley 83 carries a pair of independent conduits in the form of individually hydraulic hoses 91, 92 one on top of the other and the angularly mounted hose pulley 84 similarly carries a pair of hoses 93, 94. The hoses 91, 92, 93, 94 extend downwardly at the rear of the jacks 42, 43 on the laterally outer sides of the chains 61, 62 to where their lower rear ends connect to a pair of hydraulic manifolds 96, 97 secured to the brace 37 of inner mast section 32. The hoses 91, 92, 93, 94 extend downwardly at the front of jacks 42, 43 on the laterally inner sides of the carriage chains 61, 62 to the space between transverse plates 66, 69 of the carriage 67 and, thence, extend laterally outwardly between the plates 66, 69, then upwardly to manifolds 101, 102 mounted on the rear of the upper plate 66 of the carriage 67. The manifolds 101, 102 are adapted to be connected to hoses of attachments, not shown, selectively mounted on the carriage 67. The arrangement of hoses 93, 94 comprises substantially the reverse image of the arrangement of hoses 91, 92.

A pair of elongated load carrying members in the form of lift chains 103, 104 have their upper rear ends connected to mounting lugs 106, 107 having threaded studs 108, 109 extending through vertical openings in cross brace 16 of the outer mast section 12. A pair of nuts 111, 112 on studs 108, 109 secure the lugs 106, 107 to the cross brace 16. The chains 103, 104, extend downwardly from their connection with the cross brace 16 and around the lower half of a pair of load pulleys 113, 114 and then extend upwardly at the front of the pulleys 113, 114 to terminal blocks 116, 117, shown in FIGS. 6 and 8, which are secured by welding to the transverse brace 37. A third pair f hoses 121, 122 and a fourth pair of hoses 123, 124 extend forwardly from the lift truck frame 18, thence upwardly at the rear of the channels 13, 14 of the outer mast section 12, thence, inwardly to a pair of manifolds 126, 127 secured to cross brace 16. A fifth pair of hoses 131, 132 and a sixth pair of hoses 133, 134 extend downwardly from the manifolds 126, 127 and are trained, one on top of the other, about a pair of hose pulleys 136, 137 and extend upwardly at the front of the pulleys to where they connect the manifolds 96, 97 mounted on cross brace 37 of the inner mast section 32. The load pulleys 113, 114 are rotatably mounted on stationary stub axles 141, 142 on a first transverse axis 143 and the hose pulleys 136, 137 are rotatably mounted on the stub axles 141, 142 on a second transverse axis 144 spaced above and forwardly from transverse axis 143. The stub axles 141, 142 are welded to a pair of vertical plates 146, 147 which are welded to cross brace 31 and reinforced by plates 148, 149 welded thereto. Further, reinforcement for the plates 146, 147 is provided by brace elements 151, 152, 153, 154 so that the plates 146, 147 and interconnecting plate 149 properly support the piston 47 of lift jack 41. The piston 47 is secured to the plate 149 by a cap screw extending upward through a vertical bore in the plate 149 and threadedly engaging a drilled and tapped opening in the piston 47. The hose pulleys 136, 137 are on the laterally inner side of the load pulleys 113, 114 about which the load carrying chains are trained.

OPERATION

When hydraulic pressure fluid is delivered to the lift jacks, the carriage lift jacks 42, 43 will be extended causing the carriage 67 to be elevated on the inner mast section 32 while the intermediate and outer mast sections 26, 12 remain stationary. When the pistons 53, 54 reach the limit of their stroke, the carriage will be at the top of the inner mast section 32 and further delivery of pressure fluid to the lift jack cluster 41, 42, 43 will cause the central jack 41 to expand causing inner mast section 32 to be moved upwardly relative to the intermediate mast section 26. As the inner mast section 32 moves upwardly relative to the intermediate mast section 26, the load carrying chains 103, 104 will elevate the intermediate mast section 26 on the stationary outer mast section 12. The hoses 131, 132, 133, 134 will move about their pulleys 136, 137 as the load carrying chains 103, 104 move about their pulleys 113, 114. Likewise, as the carriage lift chains 61, 62 move about their pulleys 58, 59 during raising and lowering of the carriage on the inner mast section 32, the hoses 91, 92 93, 94 will move over their pulleys 83, 84. There is substantially zero relative vertical movement between the hoses 91, 92, 93, 94 and the chains 61, 62. Likewise, there is substantially zero relative vertical movement between the hoses 131, 132, 133, 134 and chains 103, 104. Thus, scuffing of the hoses is substantially avoided.

By mounting the hose pulleys 83, 84 in oblique relation to and above the chain pulleys 58, 59 the hoses 91, 92, 93, 94 and their pulleys 83, 84 do not require a greater fore and aft mast dimension than that already required for the chains 61, 62 and their associated pulleys 58, 59. Further, it will be noted in FIG. 1 that the rear parts of hoses 91, 93 extend laterally outwardly beyond the carriage lift jack cylinder 51, 52 only a small distance so as to permit desired visibility through the mast. Space is also conserved by running or training the pairs of hoses over their pulleys one vertically above the other. Each hose pulley has a groove, such as groove 161 in pulley 136 shown in FIG. 6, which groove is slightly wider than the diameter of hoses 131, 132 and has depth equal approximately to one and one-half hose diameters. The desirability of conserving lateral space is apparent when viewing the bottom of the mast as shown in FIGS. 1 and 6. By providing connecting manifolds 101 and 102 on the carriage any one of numerous commercially available attachments mountable on the carriage can be controlled thus permitting the lift truck to be used for a wide variety of material handling jobs.

The embodiments of the invention in which an exclusive property or privilege is claimed are defined as follows:

1. In a lift truck of the type having a mast, a carriage mounted on the mast for vertical movement at the front of the latter and a vertically disposed hydraulic lift jack for raising and lowering said carriage on said mast, the combination comprising:

a first pulley mounted on the upper end of said jack for rotation about a horizontal transverse axis, an elongated flexible load support member trained over said first pulley and having its opposite ends connected to said carriage and mast, a second pulley rotatably mounted on the upper end of said jack in a position above said first pulley and on a horizontal axis lying in a vertical plane disposed at an acute angle to said axis of said first pulley, and a pair of flexible conduits for independently conveying hydraulic fluid between said carriage and said truck trained over said second pulley in one on top of the other relationship and extending downwardly at the front of said jack on one lateral side of said flexible load support member.

2. The combination of claim 1 wherein said first and second pulleys are aligned with said jack.

3. The combination of claim 1 wherein said pair of flexible coduits extend downwardly from said second pulley at the rear of said jack on the other lateral side of said flexible load support member.

4. In a lift truck with a mast having inner, intermediate and outer relatively reciprocating vertical mast sections, a pulley and hose arrangement comprising:

a load pulley rotatably mounted on the lower end of said intermediate mast section on a horizontal axis and an elongated flexible load carrying member connected at one end to the upper part of said outer mast section extending downwardly around said load pulley and thence upwardly to a point of connection with said inner mast section, a hose pulley with a deep annular groove rotatably mounted on the lower end of said intermediate mast section on a horizontal axis, and a pair of hydraulic hoses extending downwardly from the upper part of said outer mast section, around the lower part of said hose pulley and thence upwardly to the bottom of said inner mast section, said hoses being disposed in said groove in one on top of the other relationship.

5. The combination of claim 4 wherein said pulleys are on a common shaft and said axes are transversely disposed.

6. The combination of claim 5 wherein said axes are spaced from one another.

7. The combination of claim 6 wherein said axis of said load pulley is below and to the rear of said hose pulley.

8. The combination of claim 7 wherein said load pulley is disposed on the laterally outer side of said hose pulley.

9. The combination of claim 4 wherein said load pulley is on the laterally outer side of said hose pulley.

10. The combination of claim 9 and further comprising a stationary shaft on said intermediate mast section supporting said pulleys.

11. A mast for a lift truck comprising:

an outer mast section adapted for connection to the frame of a flift truck, an intermediate mast section mounted on said outer mast section for vertical reciprocating movement relative thereto, an inner mast section mounted on said intermediate mast section for vertical reciprocating movement relative thereto, a carriage mounted on said inner mast section for vertical reciprocating movement relative thereto and adapted to support a load carrying attachment at the front of said mast, hydraulic lift jack means including a first vertical jack operatively interposed between said inner and intermediate mast sections and a second vetical jack operatively associated with said inner mast section and said carriage, a support pulley rotatably mounted on the upper end of said second jack on a horizontal axis, a first hose pulley rotatably mounted on said second jack above said load pulley on a horizontal axis, an elongated flexible load support member trained over said support pulley having one end connected to said intermediate mast section and having its other end connected to said carriage, first hydraulic hose means extending upwardly from said carriage over the top of said first hose pulley and thence downwardly to the lower part of said inner mast section, a load pulley rotatably mounted on the lower end of said intermediate mast section, an elongated flexible load carrying member trained about said load carrying pulley having one end connected to said inner mast section and its other end connected to the upper part of outer mast section, a second hose pulley rotatably mounted on the lower end of said intermediate mast section, and second hydraulic hose means connected at one end to said first hose means at the lower part of said inner mast and trained over said second hose pulley with a rear part extending upwardly to the upper part of said outer mast section.

12. The mast of claim 11 wherein one of said hose means includes a pair of hoses trained one vertically above the other around its associated pulley.

13. The mast of claim 11 wherein each of said hose means include a pair of hoses disposed one above the other about their associated pulleys.

14. The mast of claim 11 wherein said first hose pulley is oblique to said support pulley.

15. The mast of claim 14 wherein said first hose means includes a pair of hoses trained one vertically above the other around said first hose pulley.

16. The mast of claim 11 wherein said load pulley is on one lateral side of said second hose pulley.

17. The mast of claim 16 and further comprising a stationary shaft mounted on said intermediate mast section rotatably supporting said load pulley and said second hose pulley.

18. The mast of claim 17 wherein the axes of said load pulley and second hose pulley are spaced from and parallel to one another.

* * * * *